United States Patent [19]

Martens

[11] 3,989,230

[45] Nov. 2, 1976

[54] SLAB EXTRUDING MACHINE

[75] Inventor: Ernst Martens, Winnipeg, Canada

[73] Assignee: Spiroll Corporation Ltd., Winnipeg, Canada

[22] Filed: Jan. 28, 1975

[21] Appl. No.: 544,815

[30] Foreign Application Priority Data

Jan. 29, 1974 United Kingdom ..... 04038/74

[52] U.S. Cl. ..... 259/161; 259/177 R; 259/DIG. 42; 425/456; 425/432

[51] Int. Cl.[2] ..... B28C 1/00; B28C 5/18; A01J 21/00

[58] Field of Search..... 259/161, 162, 174, 178 R, 259/5, 1 R, DIG. 41, DIG. 42, DIG. 43; 425/63, 64, 456, 432; 264/71, 72; 308/20, 237 R, 239

[56] References Cited

UNITED STATES PATENTS

| | | | |
|---|---|---|---|
| 2,398,455 | 4/1946 | Unger | 259/DIG. 42 |
| 3,159,897 | 12/1964 | Ellis et al. | 425/432 X |
| 3,284,867 | 11/1966 | Booth | 425/456 X |
| 3,528,144 | 9/1970 | Haponski | 425/432 |
| 3,877,860 | 4/1975 | Putti | 425/432 X |

*Primary Examiner*—Peter Feldman
*Assistant Examiner*—Robert Pous
*Attorney, Agent, or Firm*—Stanley G. Ade

[57] ABSTRACT

A plurality of spaced and parallel auger assemblies are supported in cantilever fashion and extend rearwardly from a bearing housing. These auger assemblies in conjunction with a packing chamber and concrete hopper, extrude a longitudinally apertured slab behind a machine which is moved along rails by the compression and extrusion of the slab. The bearing housing is resiliently supported upon the main frame and is vibrated by one or more vibration generators or motors operatively connected to the bearing housing which in turn transmits the vibration to the individual auger assemblies thus assisting in the flowing and compacting of the concrete being augered by the auger assemblies. This permits auger assemblies of relatively small diameters to be used so that a relatively thin slab can be manufactured by the device.

14 Claims, 10 Drawing Figures

SLAB EXTRUDING MACHINE

BACKGROUND OF THE INVENTION

This invention relates to new and useful improvements in slab extruding machines of the type wherein a frame is mounted upon wheels on a pair of rails between which a pallet extends. A hopper is mounted on the frame and feeds concrete or the like downwardly to a set of augers which are rotated by a source of power. These augers pick up the concrete and compress it within a packing chamber to form the slab with longitudinal bores therethrough formed by the augers. The compression of the concrete drives the machine forwardly on the rails with the slab being extruded therebehind.

Conventional machines are of sufficient dimensions to form a slab 6, 8 or more inches in thickness so that there is plenty of room within the augers to provide vibrators in order to assist in the compaction of the concrete.

However, when it is desired to produce a slab having a thickness less than 6 inches (as for example, 4 inches) the augers of necessity have to be of such a small diameter that it is not possible to engage vibrators therewithin.

SUMMARY OF THE INVENTION

The present device enables a machine to be manufactured so that a relatively thin cross section slab can be formed. This is obtained by mounting the augers in a cantilever fashion from a main support which in turn is vibrated from an external source so that the augers themselves impart the vibration to the concrete being formed thereby.

The principal object and essence of the invention is therefore to provide a slab extrusion machine in which the entire auger assembly is vibrated thus enabling the machine to extrude slabs having a relatively shallow depth.

Another object of the invention is to provide a device of the character herewithin described in which the principles utilized can, of course, be incorporated in concrete slab extruding machines for the forming of slabs of conventional thicknesses.

A further object of the invention is to provide a device of the character herewithin described which is simple in construction, economical in operation and otherwise suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

In the drawings like characters of reference indicate corresponding parts in the different figures.

DETAILED DESCRIPTION

Figure 6:
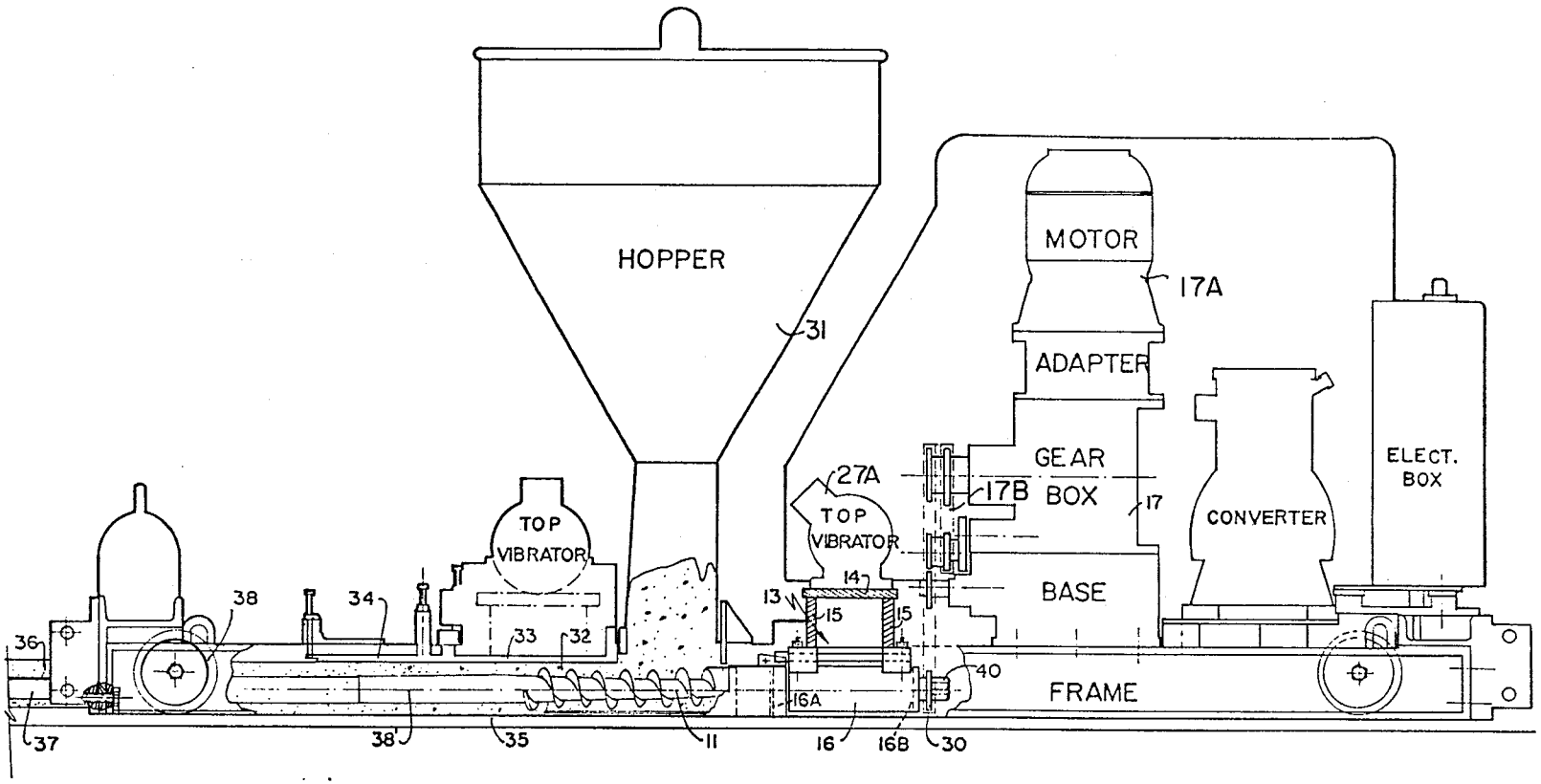
FIG. 6 is a partially schematic and partially sectioned side elevation of the preferred embodiment incorporated in a typical slab extruding machine.

Proceeding therefore to describe the invention in detail, reference character 10 illustrates, in phantom, part of the main frame of the extruder which is conventional in construction and is shown in FIG. 6 hereinafter to be described.

Figure 5:
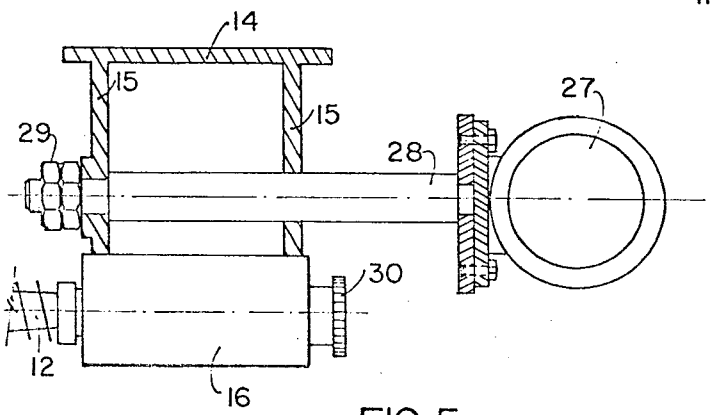
FIG. 5 is an enlarged fragmentary view substantially along the line 5—5 of FIG. 1.

A plurality of left and right-hand rotating augers 11 and 12 are supported in spaced and parallel relationship one with the other, between the frame members 10 and within a transversely extending bearing housing 13. A partial cross section of this bearing housing is shown in FIG. 5 and it will be seen that it includes a top plate 14, front and rear side plates 15, and bearing assemblies 16 within which the front end of each auger is supported for rotation in a cantilever fashion with the remainder of the auger extending rearwardly therefrom and being connected to a source of power 17A as shown schematically in FIG. 6.

Figure 4:
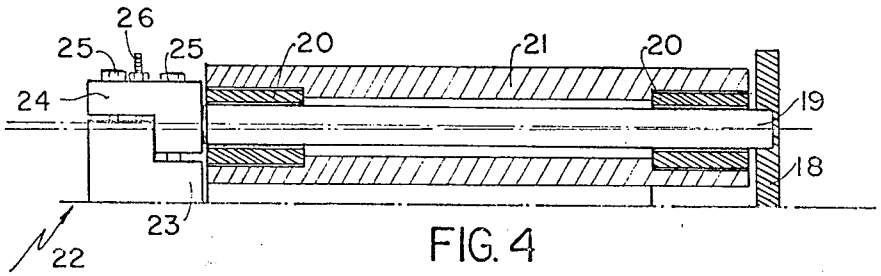
FIG. 4 is an enlarged section of one of the housing supports substantially along the line 4—4 of FIG. 1.
Figure 3:
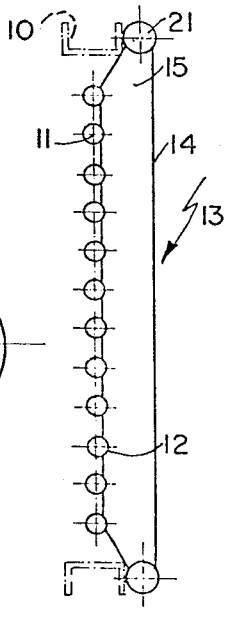
FIG. 3 is an end view of FIG. 1.

The bearing housing in turn is supported at either side upon the frame members 10 and FIG. 4 shows details of one embodiment of this support.

Figure 2:
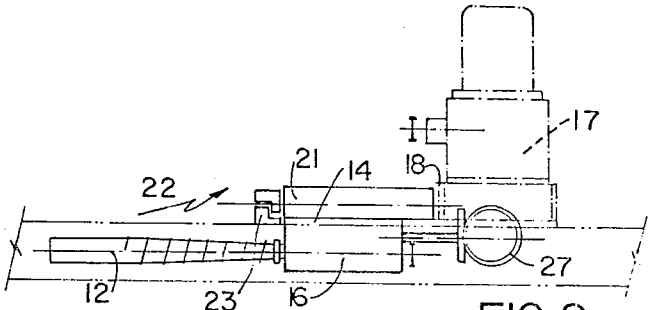
FIG. 2 is a side view of FIG. 1.
Figure 1:
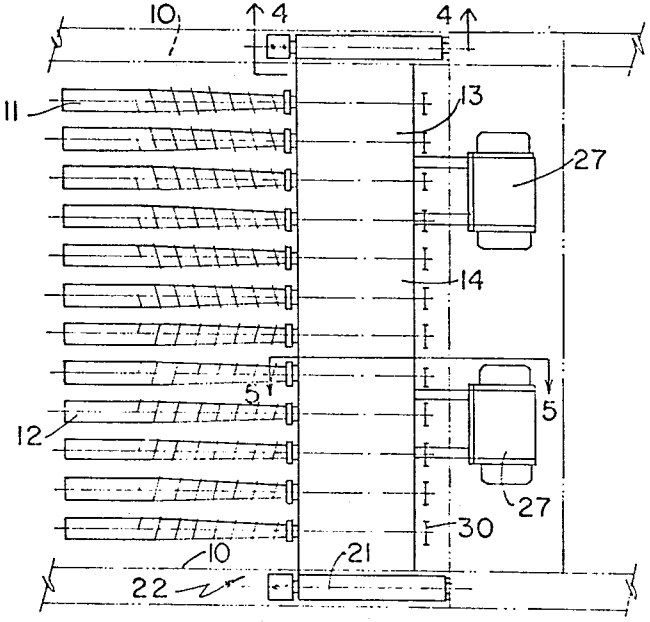
FIG. 1 is a schematic top plan view of the vibrators, bearing housing and auger supports per se.

In FIGS. 1 and 2, reference character 17 shows in phantom the gear box and drive assembly for the augers which includes a transverse base plate 18 mounted between the frame members 10. At each end of the base plate, a spindle 19 extends rearwardly and is provided with resilient bushings 20 at either end thereof with a sleeve 21 mounted upon the bushings and the bearing housing 13 extends between the sleeves 21 and is secured to and supported thereby so that the entire auger assembly is resiliently mounted upon the resilient bushings and supported by the shafts or spindles 19.

An adjustment and support assembly collectively designated 22 is situated upon the rear end of the shaft 19. This includes an L-shaped block 23 secured to the frame members 10 and a reverse L-shaped block 24 secured to the end of spindle 19 and engaged upon the block 23 as clearly shown.

Bolt assemblies 25 and 26 permit adjustment of the space between the blocks and hence assist in supporting the bearing housing in the desired horizontal position with limited adjustment up and down being permitted by the bolt assemblies 25 and 26 which are adjustable so that the attitude of the augers 12 and 13 is adjustable within limits relative to the horizontal.

A pair of vibrator generators or motors 27 are provided and are connected to the bearing housing 14 as shown in FIG. 5. A vibrator mounting bracket in the form of a shaft or spindle 28 is secured by nuts 29 to the rear member 15 of the bearing housing, extends through the bearing housing and through an aperture within the front member 15 and then extends forwardly to the motor 27 which is mounted upon the front ends of these spindles as clearly shown.

The vibrator motors are clamped securely to the bearing housing and the motors are designed to provide vertical vibration to the housing. The housing being mounted by sleeve 21 on the resilient bushings 20, is therefore vibrating the entire auger assembly in a very slight vertical arc.

This facilitates the flowing of the concrete being augered by the augers 11 and 12 and enables the diameter of the augers to be relatively small thus forming a slab having a relatively small thickness.

Auger shrouds (not illustrated) are provided for each auger to prevent the individual augers from interfering with the flow of concrete relative to the adjacent augers. The principle of these shrouds is well known and this principle is therefore not illustrated in the attached drawings.

Reference should be made to FIG. 5 in which reference character 30 illustrates a drive sprocket on the front end of the augers on the underside of the auger support bearings 16. These sprockets are operatively connected to the gear box 17 for rotating the augers in the desired direction and at the desired speed.

FIGS. 6 through 10 show the preferred embodiment of the device and dealing first with FIG. 6, a fragmentary partially sectioned view of the extruding machine is illustrated for explanatory purposes.

Reference character 31 illustrates a concrete hopper which leads into a packing or moulding chamber illustrated by reference character 32 and the auger assemblies 11 auger the concrete from the base of the hopper into packing chamber. This packing chamber includes an upper hammering plate 33 and an upper trowelling plate 34 therebehind. Side plates (not illustrated) in conjunction with the hammering and trowelling plates and a pallet 35, define the concrete slab 36 which is extruded behind the machine and is provided with longitudinally extending apertures 37 formed by the auger assemblies 11 which include the mandrel portion 38' on the ends thereof.

The entire machine is mounted upon wheels 38 which engage rails (not illustrated) one upon each side of the pallet 35.

Reference character 10 illustrates the spaced and parallel side frame members hereinbefore described and reference character 16 illustrates the bearing housing within which the auger assemblies are supported for rotation in a cantilever fashion also as hereinbefore described.

Figure 7:
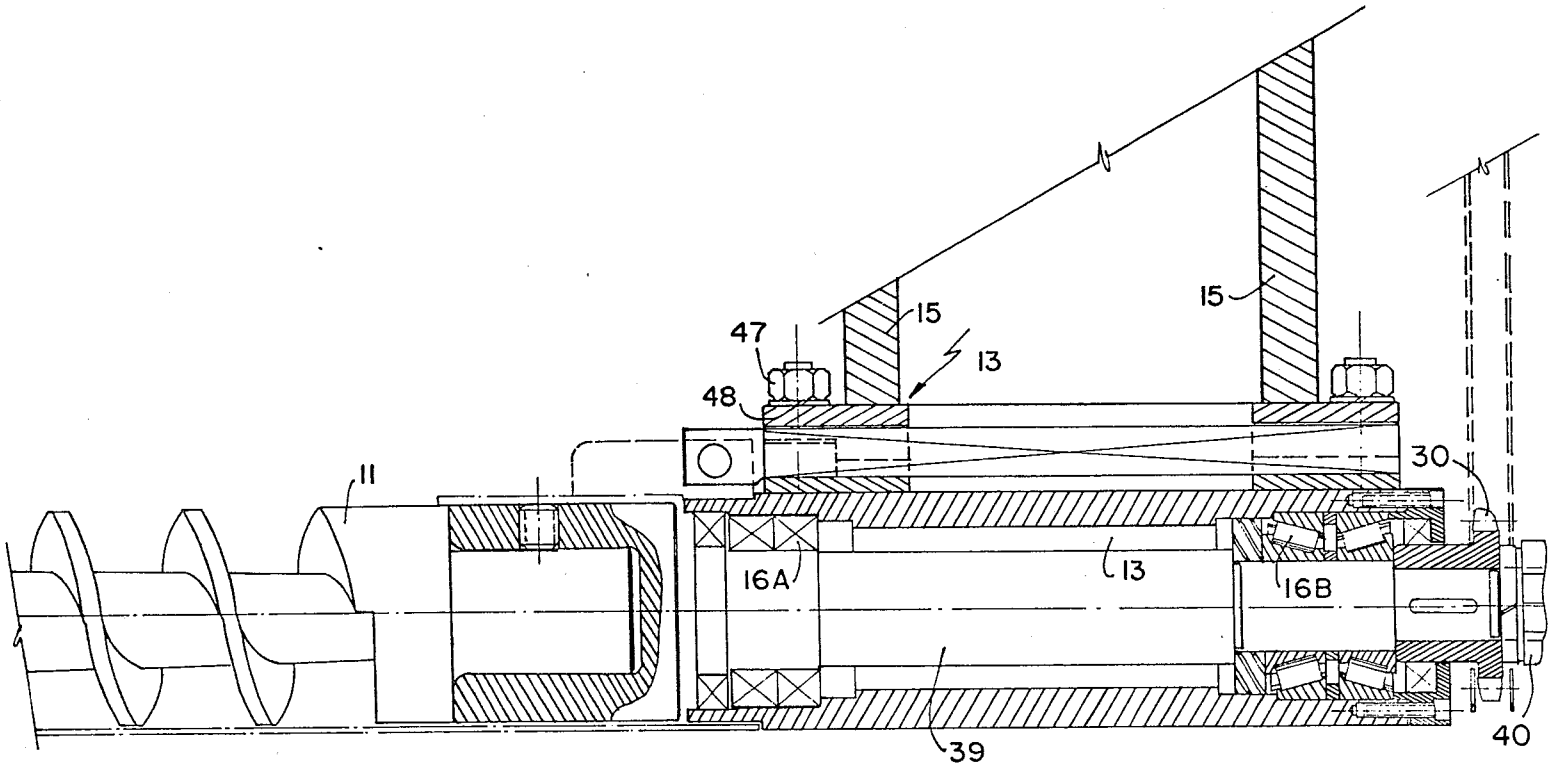
FIG. 7 is a fragmentary cross sectional side view of the bearing housing and support for one of the auger assemblies.

FIG. 7 shows details of the support of these auger assemblies, said auger assemblies including bearing support spindles 39 which in turn are journalled within front and rear bearing assemblies 16A and 16B which in turn are supported within the bearing housing 16 in the conventional manner. The sprocket 30 is secured to the front ends of the support spindles 39, by means of nut 40 and is operatively connected to the source of power 17A by means of drive chains 17B or the like.

Figure 9:
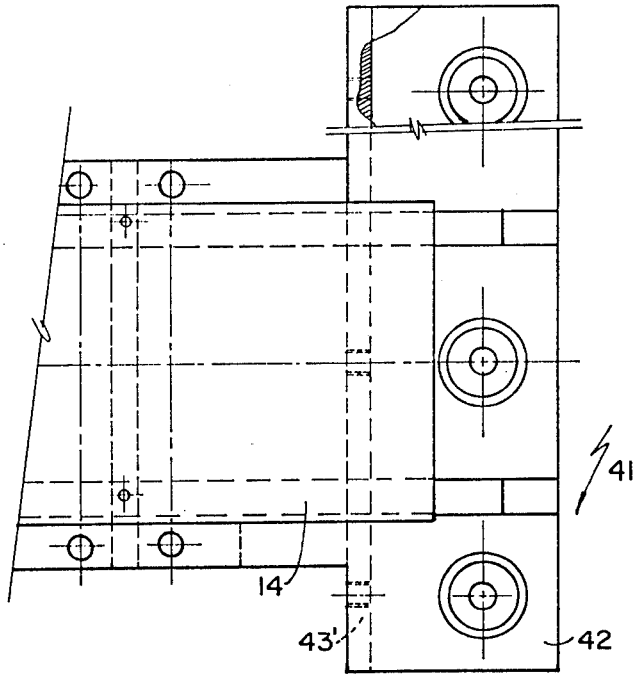
FIG. 9 is a fragmentary top plan view of the bearing housing per se.
Figure 8:
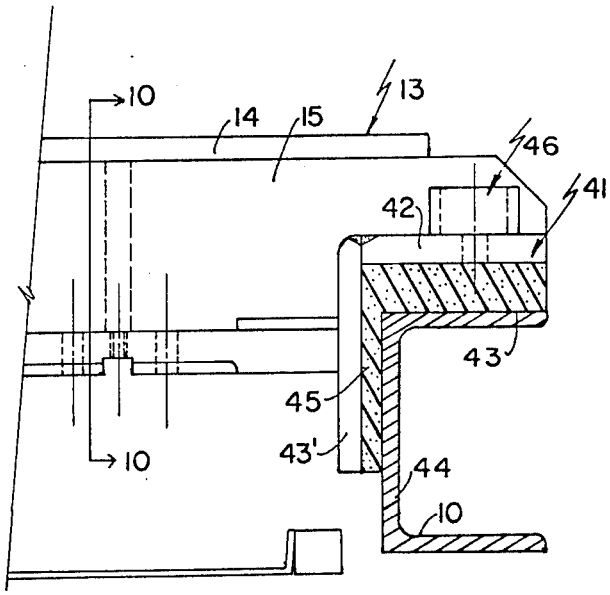
FIG. 8 is a fragmentary end view showing the method of attachment of the bearing housing to the side frame members.
Figure 10:
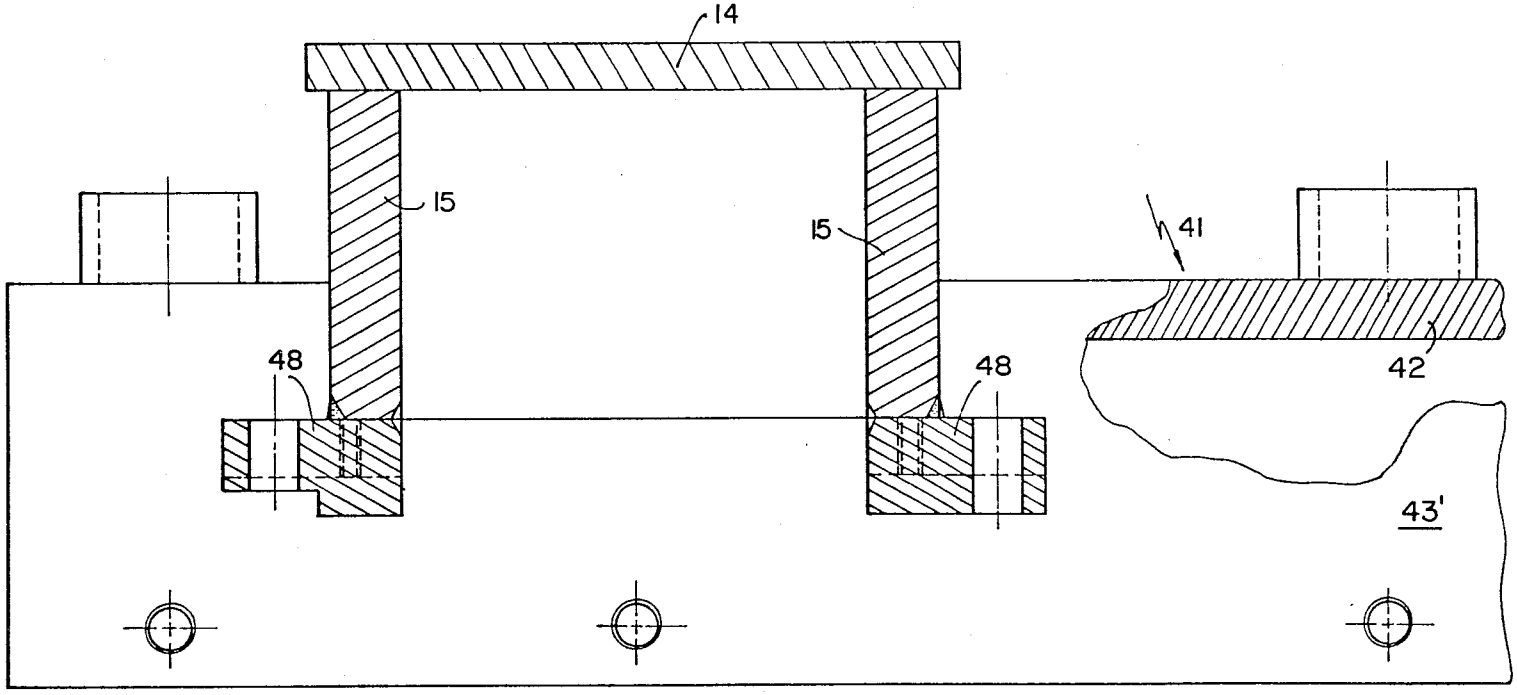
FIG. 10 is a cross sectional view of FIG. 8 substantially along the line 10—10, but with the supporting frame deleted.

FIGS. 8, 9 and 10 show details of the bearing housing 13. This housing includes the aforementioned front and rear side plates 15 and the top plate 14 hereinbefore described.

In this embodiment, longitudinally extending support brackets, collectively designated 41, are secured to each end of the front and rear side plates 15 and extend longitudinally or parallel to the side frame members 10.

These support brackets include a planar upper plate 42 and a planar vertical plate 43' secured to one edge of the upper horizontal plate 42 and extending downwardly at right angles therefrom thus forming a right angled channel which engages over the upper flange 43 and part of the vertical web 44 of the longitudinally extending side frame member 10.

A right angulated resilient pad or spacer 45 is situated between the support bracket 41 and the side frame member 10 and the support bracket 41 is secured to the upper flange 43 of the side frame member by means of vibration isolating nut and bolt assemblies illustrated by reference character 46 and which are conventional in construction, so that it is not believed necessary to describe same further.

These nut and bolt assemblies 46 secure the bearing housing to the side frame members yet isolate one from the other insofar as vibration is concerned.

The front and rear side plates 15 of the bearing housing are welded to the support brackets 41 intermediate the ends of the support brackets as clearly illustrated.

The vibration generating means take the form of vibrators 27A and in this embodiment are secured directly to the top plate 14 of the bearing assemblies thus transmitting vibrations from the vibrators, through the bearing housing to the auger assemblies 11, said vibrations being isolated from the side frame members due to the resilient members or pads 45.

As in the previous embodiment, the provision of the vibrators upon the bearing housing provides the necessary vibration to the bearing assemblies, which in this embodiment, are too small in diameter to contain individual vibrators as is conventional.

However, it is to be appreciated that this particular construction is not necessarily limited to auger assemblies having a relatively small diameter but can, of course, be used with conventionally sized auger assemblies.

Finally, the portion of the bearing housing containing the bearing assemblies 16A and 16B is secured to the lower sides of the front and rear side plates 15 by means of stud and nut assemblies 47 which engage through offstanding flanges 48 extending from the lower side edges of the front and rear side plates 15.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim is:

1. In a slab extrusion machine which includes a longitudinally extending main frame having a pair of spaced and parallel side frame members and a plurality of spaced and parallel auger assemblies situated between said side frame members and extending parallel thereto; means to mount said auger assemblies between said side frame members, said means including a transversely situated bearing housing, means supporting said auger assemblies by one end thereof in side by side relationship within said bearing housing, vibration generating means operatively connected to said bearing housing, and resilient mounting means supporting said bearing housing between said side frame members whereby vibration generated by said vibration generating means, is transmitted through said bearing housing to said auger assemblies, said resilient mounting means including a longitudinally extending sleeve at each end of said bearing housing, a stationary spindle supported by one end thereof upon each of said side frame members and extending through said sleeves substantially parallel to said side frame members, resilient bushings mounting said sleeves one upon each of said spindles, and vertical adjustment means supporting the other end of said spindles upon said side frame members.

2. The invention according to claim 1 in which said vertical adjustment means includes an L-shaped block secured to said side frame member and a reverse L-shaped block secured to said other end of said spindle and adjustable bolt means operatively connecting said reverse L-shaped block to said L-shaped block for limited vertical adjustment therebetween.

3. The invention according to claim 1 which includes means to support said vibration generating means upon said bearing housing in which said bearing housing includes transversely extending front and rear side plates and a top plate spanning the upper edges of said side plates, a support spindle secured by one end thereof to one of said side plates and extending through an aperture and the other of said side plates, said support spindle extending beyond said other side plate, said vibration generating means being secured to the distal end of said support spindle extending beyond said other side plate.

4. The invention according to claim 3 in which said vertical adjustment means includes an L-shaped block secured to said side frame member and a reverse L-shaped block secured to said other end of said spindle and adjustable bolt means operatively connecting said reverse L-shaped block to said L-shaped block for limited vertical adjustment therebetween.

5. The invention according to claim 2 which includes means to support said vibration generating means upon said bearing housing in which said bearing housing includes transversely extending front and rear side plates and a top plate spanning the upper edges of said side plates, a support spindle secured by one end thereof to one of said side plates and extending through an aperture and the other of said side plates, said support spindle extending beyond said other side plate, said vibration generating means being secured to the distal end of said support spindle extending beyond said other plate.

6. The invention according to claim 1 in which said bearing housing includes a longitudinally extending support bracket at each end thereof engageable upon said side frame members, a resilient pad member operatively connected between said support bracket and said side frame member and vibration isolating bolt assemblies securing said support brackets to said side frame members.

7. The invention according to claim 6 which includes means to support said vibration generating means on said bearing housing in which said bearing housing includes transversely extending front and rear side plates and a top plate spanning the upper edges of said side plates, said side plates being supported by the ends thereof to each of said support brackets, said vibration generating means being operatively connected to said top plate.

8. A slab extrusion machine comprising in combination a longitudinally extending main frame, said main frame including a pair of spaced and parallel side frame members, a source of power mounted on said main frame, a material holding hopper mounted on said main frame, a moulding chamber on said main frame, said hopper communicating with said moulding chamber, a plurality of spaced and parallel auger assemblies within said main frame between said side frame members and extending parallel thereto, means to mount said auger assemblies between said side frame members with said auger assemblies extending into said moulding chamber, said means including a transversely situated bearing housing, means supporting said auger assemblies by one end thereof in side by side relationship within said bearing housing, vibration generating means operatively connected to said bearing housing, and resilient mounting means supporting said bearing housing between said side frame members whereby vibration generated by said vibration generating means, is transmitted through said bearing housing to said auger assemblies, said source of power being operatively connected to said auger assemblies, said resilient mounting means including a longitudinally extending sleeve at each end of said bearing housing, a stationary spindle supported by one end thereof upon each of said side frame members and extending through said sleeves substantially parallel to said side frame members, resilient bushings mounting said sleeves one upon each of said spindles, and vertical adjustment means supporting the other end of said spindles upon said side frame members.

9. The invention according to claim 8 in which said vertical adjustment means includes an L-shaped block secured to said side frame member and a reverse L-shaped block secured to said other end of said spindle and adjustable bolt means operatively connecting said reverse L-shaped block to said L-shaped block for limited vertical adjustment therebetween.

10. The invention according to claim 8 which includes means to support said vibration generating means upon said bearing housing in which said bearing housing includes transversely extending front and rear side plates and a top plate spanning the upper edges of said side plates, a support spindle secured by one end thereof to one of said side plates and extending through an aperture and the other of said side plates, said support spindle extending beyond said other side plate, said vibration generating means being secured to the distal end of said support spindle extending beyond said other side plate.

11. The invention according to claim 9 which includes means to support said vibration generating means upon said bearing housing in which said bearing housing includes transversely extending front and rear side plates and a top plate spanning the upper edges of said side plates, a support spindle secured by one end thereof to one of said side plates and extending through an aperture and the other of said side plates, said support spindle extending beyond said other side plate, said vibration generating means being secured to the distal end of said support spindle extending beyond said other side plate.

12. The invention according to claim 8 in which said bearing housing includes a longitudinally extending support bracket housing includes a longitudinally extending support bracket at each end thereof engageable upon said side frame members, a resilient pad member operatively connected between said support bracket and said side frame member and vibration isolating bolt assemblies securing said support brackets to said side frame members.

13. The invention according to claim 12 which includes means to support said vibration generating means on said bearing housing in which said bearing housing includes transversely extending front and rear side plates and a top plate spanning the upper edges of said side plates, said side plates being supported by the ends thereof to each of said support brackets, said vibration generating means being operatively connected to said top plate.

14. The invention according to claim 10 in which said vertical adjustment means includes an L-shaped block secured to said side frame member and a reverse L-shaped block secured to said other end of said spindle and adjustable bolt means operatively connecting said reverse L-shaped block to said L-shaped block for limited vertical adjustment therebetween.

* * * * *